US005236120A

United States Patent [19]

Kleemola

[11] Patent Number: 5,236,120

[45] Date of Patent: Aug. 17, 1993

[54] CONTAINER AND A LID FOR CLOSING THE SAME

[75] Inventor: Pertti Kleemola, Valkeakoski, Finland

[73] Assignee: Yhtyneet Paperithehtaat Oy, Valkeakoski, Finland

[21] Appl. No.: 848,956

[22] PCT Filed: Nov. 16, 1990

[86] PCT No.: PCT/FI90/00277

§ 371 Date: Apr. 22, 1992

§ 102(e) Date: Apr. 22, 1992

[87] PCT Pub. No.: WO92/04187

PCT Pub. Date: Mar. 19, 1992

[30] Foreign Application Priority Data

Nov. 22, 1989 [FI] Finland ..... 895565

[51] Int. Cl.[5] ..... B65D 3/26; B65D 3/30

[52] U.S. Cl. ..... 229/5.5; 229/123.2; 229/201; 229/242

[58] Field of Search ..... 229/4.5, 5.5, 5.8, 123.2, 229/201, 240, 242

[56] References Cited

U.S. PATENT DOCUMENTS

| | | | |
|---|---|---|---|
| 889,758 | 6/1908 | Burke | 229/5.5 |
| 1,096,880 | 5/1914 | Wright . | |
| 1,325,930 | 12/1919 | Drake . | |
| 1,463,437 | 7/1923 | Oliver | 229/5.5 |
| 1,627,042 | 5/1927 | Mason et al. . | |
| 2,415,625 | 2/1947 | Coker, 3rd | 229/5.5 |
| 2,425,708 | 8/1947 | Wilcox | 229/5.5 |
| 2,455,063 | 11/1948 | Jackson | 229/5.5 |
| 3,119,541 | 1/1964 | Lynn | 229/5.5 |
| 3,374,601 | 3/1968 | White . | |
| 4,181,219 | 1/1980 | Marion | 229/5.8 |
| 4,261,502 | 4/1981 | Ohmori | 229/1.5 B |
| 4,262,819 | 4/1981 | Hayes | 229/5.5 |
| 4,785,992 | 11/1988 | Goeppner | 229/5.5 |

FOREIGN PATENT DOCUMENTS

| | | | |
|---|---|---|---|
| 1053591 | 5/1979 | Canada . | |
| 2630022 | 11/1983 | Fed. Rep. of Germany . | |
| 70826 | 7/1986 | Finland . | |
| 789065 | 10/1935 | France . | |
| 926130 | 9/1947 | France | 229/5.5 |
| 175388 | 5/1961 | Sweden . | |
| 159547 | 4/1933 | Switzerland | 229/242 |
| 719404 | 12/1954 | United Kingdom | 229/5.5 |

*Primary Examiner*—Gary E. Elkins
*Attorney, Agent, or Firm*—Ladas & Parry

[57] ABSTRACT

The invention relates to a container including a container body made of a paperboard-based material and having a top opening at one end, a bottom opening at an other end, a bottom closing the bottom opening, and a lid for closing the top opening. An edge area around the top opening of the container body includes a continuous body section having substantially the shape of a truncated cone, and which extends around, and tapers towards, the top opening so that the generatrix of the continuous body section is at an angle with the generatrix of the container body. The lid is detachably attached to the continuous body section and includes a section having the shape of a truncated cone and the angle of taper of which substantially corresponds to the shape of the continuous body section.

4 Claims, 2 Drawing Sheets

CONTAINER AND A LID FOR CLOSING THE SAME

This invention relates to a container comprising a container body made of a paperboard-based material and comprising a top opening at one end and a bottom opening at the other end; a bottom closing the bottom opening; and a lid for closing the top opening of the container body.

If the body of the container of the type described above is made of liquid packaging paperboard, such a container can be used, for instance, for packaging various products to be spooned out, such as ice-cream, yoghurt and pudding. In containers intended for products to be spooned out, the lid should be relatively easily and at least substantially completely detachable. Normally, this is realized in such a way that the body of the container comprises an outwardly projecting flange to the upper surface of which an even lid material is seamed. This kind of container, however, requires a relatively large space as compared with its useful volume. U.S. Pat. No. 4,261,502 and FI Published Specification 70826 disclose an alternative lid structure in which a round cup-like lid is inserted into the opening of the body and the edge area of the lid is heat-sealed to the inner surface of the body. This kind of lid is, however, rather difficult to open especially if it is to be detached completely. U.S. Pat. No. 4,261,502 also discloses a container comprising a conical body closed at the top with a lid made of aluminum foil. This container is formed by a conventional sector-shaped blank called a drink cup blank, and it requires about 15 to 20% more paperboard than a straight-walled container of equal volume. Above all, the space requirement of this kind of container is extremely great as compared with its useful volume. As the end edge of the body is positioned within the container, this container is not suitable for aseptic use.

The object of the present invention is to provide a container in which a lid which is easily detachable, also completely, can be attached to a body made of a paperboard-based material. This is achieved by means of a container of the invention, which is characterized in that an edge area around the top opening of the body comprises a continuous section having substantially the shape of a truncated cone and extending around and tapering towards the top opening, the generatrix of said body section being at an angle with the generatrix of the container body; and the lid comprises a section having substantially the shape of a truncated cone and the angle of taper of which substantially corresponds to that of the body section having the shape of a truncated cone, said lid section being attached detachably to said body section. By virtue of the shape of the sealing surface between the lid and the body, the lid is very easy to open as it can be subjected, e.g. by means of an opening tab formed peripherally in the lid, to a force the direction of which is extremely advantageous for the detachment of the lid from the body. As used in this application, the container body section having substantially the shape of a truncated cone refers to a body section which is at an angle with the main part of the body and one end of which is smaller in diameter than the other end. The shape of the ends, however, may vary: the ends can be round, oblong, rectangular with rounded corners or even more irregular in shape. Essential is that the container body section having the shape of a truncated cone comprises a continuous sealing surface extending around the top opening of the container for the lid.

The thickness of the container body section having the shape of a truncated cone can be equal to one or more material thicknesses of the body. Particularly advantageously, the thickness of the body section having the shape of a truncated cone is two or more times the material thickness of the body, whereby the edge of the body around the top opening is folded outwards upon the body. As a result, the edge of the top opening of the container is stiffened and, what is apparently even more important, the cut edge of the board, i.e. the so-called mill edge, will be positioned outside the container so that the product to be packaged into the container is not able to penetrate inside the board. As the edge portion is doubled, the layers have to be glued together if the outer surface of the container is not of a heat-sealable material. If the doubled edge is once more folded outwardly upon the body, the edge area will be threefold, and the plastic-coated inner surface of the container will be positioned against the outer surface of the body, thus enabling heat-sealing. A similar multi-layer edge area is also achieved in such way that the edge of the body is first rolled outwards and then flattened and simultaneously heat-sealed against the body.

In the following the container of the invention and a few exemplifying methods of producing such a container will be described in more detail with reference to the attached drawings, wherein FIG. 1 shows an exemplifying embodiment of a container body for a container of the invention and two mandrels used for shaping it;

Figure 1:
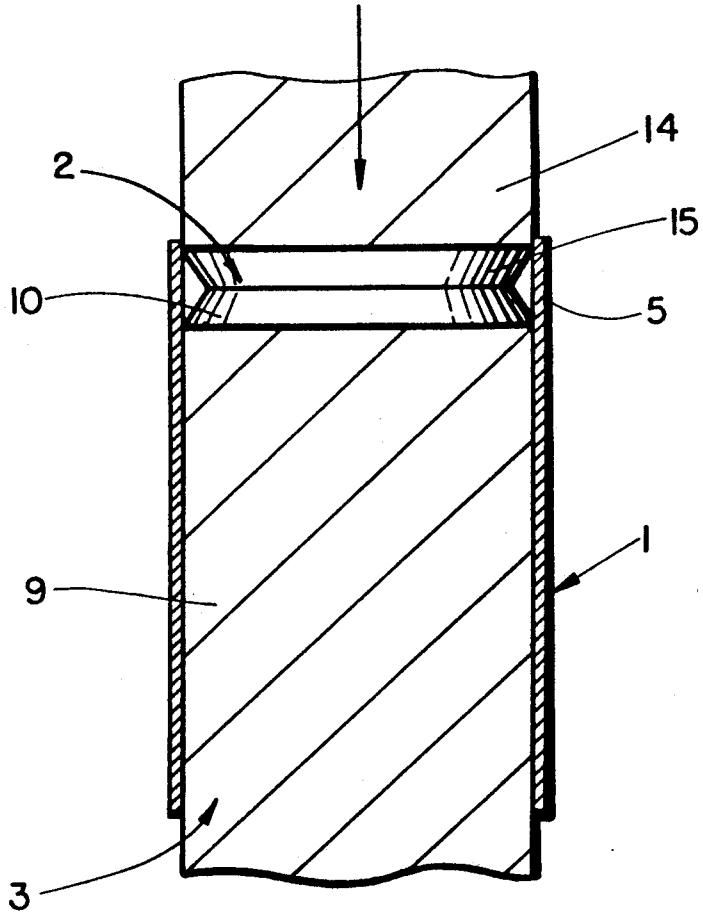

FIG. 1 shows a cylindrical container body 1 of a paperboard-based material. A mandrel 9 is inserted into the container body 1 through a bottom opening 3 at its one end, and another mandrel 14 is inserted through a top opening 2 of the container body 1. The mandrel 9 inserted through the bottom opening 3 of the container body bears on the container body 1 at least close to the top opening 2 of the container body before it tapers into a portion 10 having the shape of a truncated cone. The mandrel inserted through the top opening 2 bears on the container body 1 at the edge of the top opening 2 before it similarly tapers into a portion 15 having the shape of a truncated cone.

Figure 2:
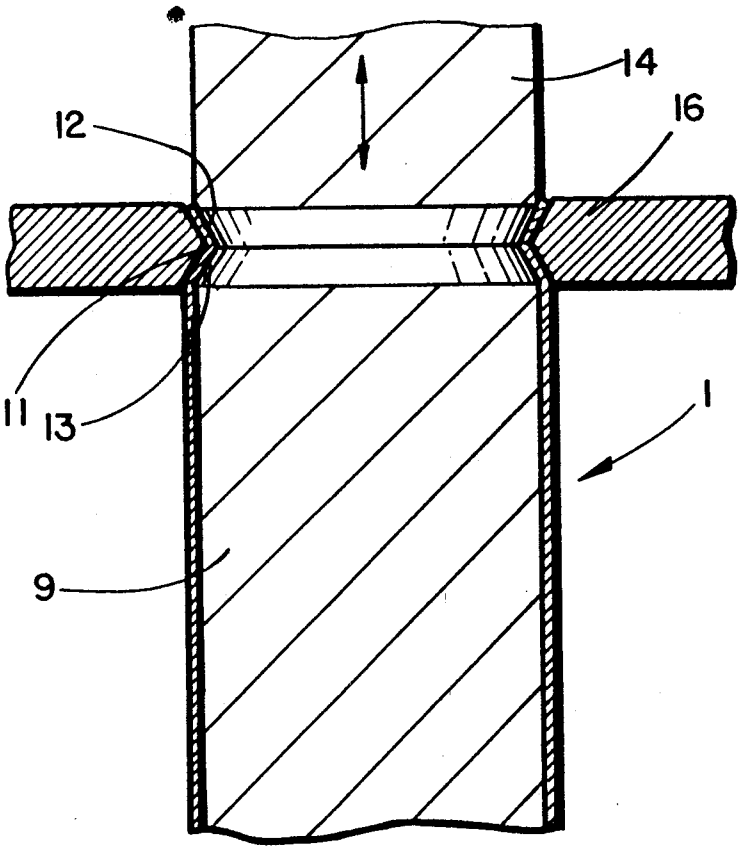
FIG. 2 shows an operational stage at which a narrowed portion V-shaped in cross-section is formed in the edge area of the container body.

As shown in FIG. 2, a narrowed portion 11 V-shaped in cross-section can be formed in an edge area 5 around the top opening 2 of the container body (FIG. 1) by means of the portions 10 and 15 of the mandrels 9 and 14, respectively. An outer section 12 having the shape of a truncated cone is formed closer to the top opening 2 and a section 13 similarly having the shape of a truncated cone is formed at a greater distance from the top opening 2 in the container body by the sides 12 and 13 of the narrowed portion 11, respectively.

Figure 3:
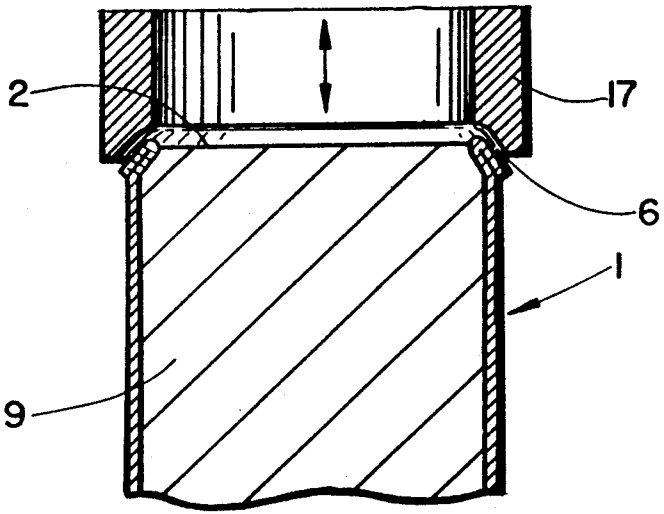
FIG. 3 shows an operational stage at which a section having the shape of a truncated cone is formed in the edge area of the container.

As appears from FIG. 3, the outer section having the shape of a truncated cone in the container body 1 can be pressed upon the inner section having the shape of a truncated cone by means of, for instance, a shaping tool 17 shown in FIG. 3, so that a section 6 having the shape of a truncated cone is formed at the edge of the top opening of the container body 1. The section 6 tapers towards the top opening 2 so that its generatrix is at an angle with the generatrix of the body 1. As the mandrel 9 with the portion having the shape of a truncated cone at its upper end is still positioned within the container body 1, the section 6 with the shape of a truncated cone can be forced very accurately into the desired shape between the mandrel 9 and the shaping tool 17. The sections 12 and 13, which form the section 6, can be heat-sealed together if the outer surface of the container body is provided with a plastic layer. Otherwise they have to be glued together.

Figure 4:
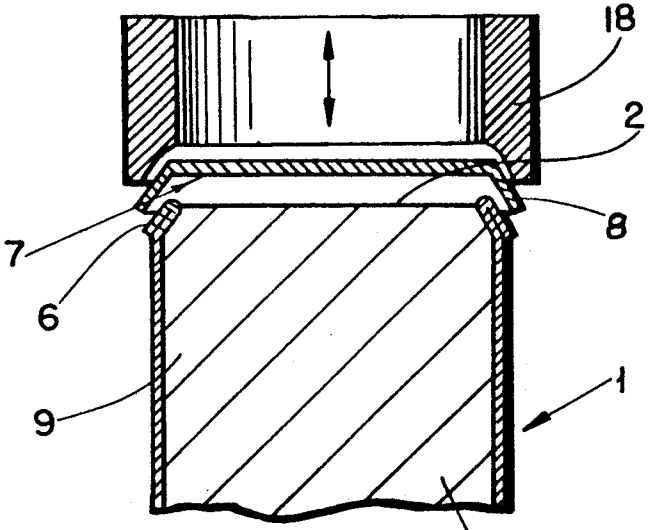
FIG. 4 illustrates the attachment of a lid to the container body.

At the operational stage shown in FIG. 4, a plane lid 7 provided peripherally with a section 8 having the shape of a truncated cone is positioned above the top opening 2 of the body 1. The angle of taper of this section is preferably equal to that of the section 6 of the body 1. The lid 7 can now be attached to the body 1, e.g., by heat-sealing the sections 6 and 8 together, e.g., by means of a lid sealing tool 18 shown in FIG. 4. The sealing can be performed extremely tightly as the mandrel 9 is still positioned within the body 1.

In this way the lid of the container can be closed very tightly, but the lid is, however, very easily openable as it can be easily subjected to a force which tends to detach it from the section 6 of the body. This detachment can be further facilitated by providing e.g. the inner surface of the lid 7, which is to be heat-sealed to the body 1, with a peelable plastic coating.

After the lid 7 has been attached to the body 1, the mandrel 9 is removed from within the body 1, whereafter the product to be packaged can, if desired, be introduced into the container body through the bottom opening of the body. The container body can also be filled through an opening made in the bottom or in the lid for the purpose, whereby the opening can be separately closeable by means of a closing plug or flap. The bottom opening of the container is closed either by suitably folding the container material or by means of a separate bottom 4 in a manner conventional in the art. U.S. Pat. No. 4,261,502, for instance, discloses ways in which the bottom can be attached to the container body.

Figure 5:
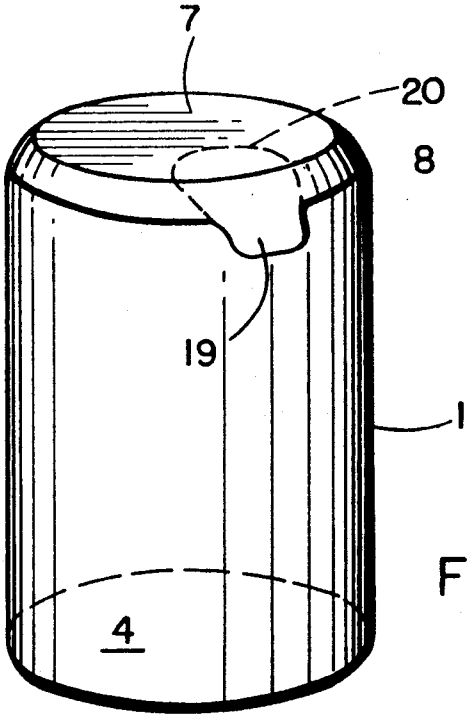
FIG. 5 shows a finished container according to one exemplifying embodiment of the invention.

The structure formed by the container body and the lid in accordance with the invention is a new combination of properties of great importance in the packaging technology. Such properties include the completely openable lid, the high ratio between the useful volume and the space requirement of the container, savings on packaging material and a new outer appearance different from other containers designed for the same purpose. A finished container of the invention is shown in FIG. 5. As appears from FIG. 5, the lid 7 is provided peripherally with a lifting tab 19 which is not heat-sealed to the body 1, so that the lid 7 is easily detachable by pulling the tab 19. In the embodiment shown in FIG. 5, the lifting tab 19 adjoins an area of the lid 7, which area is separated from the rest of the lid by means of a perforation 20 which penetrates the paperboard layer but not the plastic layer forming the inner surface of the container. This applies mainly only to containers intended for liquid products, in which case it is advisable that the lid opens only partially. If the container is to be opened by removing the lid completely, no perforation 20 is made in the lid.

The container of the invention and one specific method for producing such a container has been described above mainly by means of one exemplifying embodiment. If it is sufficient that the thickness of the body section having the shape of a truncated cone is equal to the material thickness of the body 1, this section can be formed in the edge of the body 1 either by a shaping tool similar to the tool 17 shown in FIG. 3, or by means of a shaping tool similar to the tool 16 of FIG. 2, when the mandrel 9 is inserted within the body 1 in such a way that the upper edge of its portion 10 having the shape of a truncated cone is substantially on a level with the edge of the body 1. The shape of the body 1 may also differ from the cylinder shape shown in the figures. In fact, the cross-sectional shape of the body may vary relatively arbitrarily, provided that no sharp angles are formed in the edge area of the top opening of the body. In practice, the manufacturing technique restricts the cross-sectional shape of the body mainly in that the shaping mandrel of the edge area has to be introduced within the body through its bottom opening. Therefore it is not possible that the body becomes broader in the upward direction if it is not possible to widen the mandrel in one way or another. With this kind of cross-sectional shapes the method of producing the container of the invention is similar to the method described above. Several other modifications in the exemplifying embodiment of the figures are possible without deviating from the scope of protection defined in the attached claims. Accordingly, the shape of the lid 7, for instance, may differ from that shown in the figures, provided that it comprises the section having the shape of a truncated cone to enable it to be sealed.

I claim:

1. A container comprising:

a container body made of a paperboard-based material and including a top opening at one end, a bottom opening at an other end and an edge area around the top opening of the body, said edge area being a continuous body section having substantially the shape of a truncated cone and extending around and tapering towards the top opening, a generatrix of said continuous body section being at an angle with respect to a generatrix of the container body;

a bottom closing the bottom opening;

a lid for closing the top opening of the container body, said lid including a section having substantially the shape of a truncated cone and having an angle of taper which substantially corresponds to the shape of the continuous body section, said lid section being placed over the corresponding section of the body section wherein the thickness of the continuous body section is at least two times greater than the material thickness of the body, and wherein the edge area of the body being folded outwards upon the body, said lid and said continuous body section being heat-sealed together; and a lifting tab on said lid so that said lid can be subjected to a force which tends to detach said lid from the body.

2. A container according to claim 1, wherein the lifting tab is located on a peripheral portion of said lid.

3. A container according to claim 1, wherein the lid is made of a paperboard-based material which overlays an inner plastic layer, and wherein perforations penetrate the lid so as to enable the lifting tab to be separated from the lid.

4. A container comprising:

a container body made of a paperboard-based material and including a top opening at one end, a bottom opening at an other end and an edge area around the top opening of the body, said edge area being a continuous body section having substantially the shape of a truncated cone and extending around and tapering towards the top opening, a generatrix of said continuous body section being at an angle with respect to a generatrix of the container body;

a bottom closing the bottom opening;

a lid for closing the top opening of the container body, said lid including a section having substantially the shape of a truncated cone and having an angle of taper which substantially corresponds to the shape of the continuous body section, said lid section being placed over the corresponding section of the body section wherein the thickness of the continuous body section is at least two times greater than the material thickness of the body, and wherein the edge area of the body being folded outwards upon the body, said lid and said continuous body section being attached together; and a lifting tab on said lid so that said lid can be subjected to a force which tends to detach said lid from the body.

* * * * *